US007625076B2

(12) United States Patent
Ito

(10) Patent No.: US 7,625,076 B2
(45) Date of Patent: Dec. 1, 2009

(54) INKJET HEAD INCLUDING PLATES BONDED TOGETHER BY ADHESIVE

(75) Inventor: Atsushi Ito, Nagoya (JP)

(73) Assignee: Brother Kogyo Kabushiki Kaisha, Nagoya-Shi (JP)

( * ) Notice: Subject to any disclaimer, the term of this patent is extended or adjusted under 35 U.S.C. 154(b) by 302 days.

(21) Appl. No.: 11/191,414

(22) Filed: Jul. 27, 2005

(65) Prior Publication Data

US 2006/0023033 A1 Feb. 2, 2006

(30) Foreign Application Priority Data

Jul. 29, 2004 (JP) ..... 2004-222362

(51) Int. Cl.
*B41J 2/045* (2006.01)

(52) U.S. Cl. ..... 347/72; 347/70

(58) Field of Classification Search ..... 347/71
See application file for complete search history.

(56) References Cited

U.S. PATENT DOCUMENTS 6,328,434 B1 * 12/2001 Soneda et al. ..... 347/68
6,536,879 B2 3/2003 Ito et al.
6,604,817 B2 * 8/2003 Isono et al. ..... 347/71
7,073,894 B2 * 7/2006 Isono et al. ..... 347/71
7,163,280 B2 * 1/2007 Watanabe ..... 347/68
7,360,875 B2 * 4/2008 Terakura et al. ..... 347/71
7,380,917 B2 * 6/2008 Terakura ..... 347/71
2003/0222949 A1 * 12/2003 Ito ..... 347/71
2004/0119790 A1 * 6/2004 Taira ..... 347/68

FOREIGN PATENT DOCUMENTS

JP 2002-96477 4/2002

* cited by examiner

*Primary Examiner*—Matthew Luu
*Assistant Examiner*—Shelby Fidler
(74) *Attorney, Agent, or Firm*—Reed Smith LLP

(57) ABSTRACT

An inkjet head including (a) an ink channel unit and (b) an actuator unit which are superposed on each other. The ink channel unit has (a-1) nozzles, (a-2) first recesses which are held in communication with the nozzles and which are formed in a recessed surface of the ink channel unit, and (a-3) second recesses which are isolated from the nozzles and which are formed in the recessed surface. The actuator unit has (b-1) a piezoelectric sheet straddling the first recesses, (b-2) individual electrodes located in positions opposed to the respective first recesses, and (b-3) a common electrode cooperating with each of the individual electrodes to define a portion of the piezoelectric sheet which is located between the common electrode and the each of the individual electrodes The actuator unit is fixed to the recessed surface of the ink channel unit by an adhesive, such that the first recesses are closed by the actuator unit so as to provide respective pressure chambers.

18 Claims, 12 Drawing Sheets

INKJET HEAD INCLUDING PLATES BONDED TOGETHER BY ADHESIVE

This application is based on Japanese Patent Application No. 2004-222362 filed in Jul. 29, 2004, the content of which is incorporated hereinto by reference.

BACKGROUND OF THE INVENTION

Field of the Invention

The present invention relates to an inkjet head including a plurality of plates superposed on each other and bonded together by an adhesive.

U.S. Pat. No. 6,536,879 (corresponding to JP-2002-96477A) discloses an inkjet head including; (a) a cavity unit (ink channel unit) having a plurality of nozzles, and a plurality of pressure chambers which are held in communication with the respective nozzles; and (b) a piezoelectric actuator unit including active portions each of which is operable to apply a pressure to an ink stored in a corresponding one of the pressure chambers, wherein the cavity unit and the actuator unit are fixed to each other by an adhesive which is interposed therebetween. The cavity unit is a laminar structure including a plurality of plates superposed on each other. A plurality of through-holes are formed through a base plate (i.e., an outermost one of the plurality of plates of the cavity unit) at which the cavity unit is bonded to the actuator unit. The through-holes are closed by a second outermost one of the plates (that is adjacent to the base plate) and the actuator unit bonded to the base plate, so as to serve as the pressure chambers.

It is common that the adhesive, used for fixing the cavity unit and the actuator unit, is applied onto the base plate of the cavity unit rather than onto the actuator unit. In this instance, if an excessively large amount of the adhesive is applied onto the base plate, there would be a risk that the adhesive would enter into the through-holes formed in the base plate, causing the volume of each pressure chamber to deviate from its designed value, and accordingly disabling each pressure chamber from delivering a desired amount of the ink toward the corresponding nozzle. It, on the contrary, the amount of the applied adhesive is too little, there would be a risk of ink leakage between the cavity unit and the actuator unit. Such a problem could be encountered also in bonding of the plurality of plates together by the adhesive. That is, if the applied adhesive is too much the adhesive could close holes formed in each of the plates. If the applied adhesive is too little, an ink leakage could occur. It is therefore necessary to strictly control the amount of the adhesive to be applied onto the plate, thereby complicating a process of manufacturing the inkjet head.

SUMMARY OF THE INVENTION

The present invention was made in view of the background prior art discussed above. It is therefore an object of the invention to provide an inkjet head having an arrangement enabling a permissible range of the applied adhesive amount to be increased and accordingly eliminating necessity of strictly controlling the applied adhesive amount. This object may be achieved according any one of first through third aspects of the invention which is described below.

The first aspect of the invention provides an inkjet head including (a) an ink channel unit and (b) an actuator unit which are superposed on each other, wherein the ink channel unit has (a-1) a plurality of nozzles, (a-2) a plurality of first recesses which are held in communication with the plurality of nozzles and which are formed in a recessed surface of the ink channel unit, and (a-3) a plurality of second recesses which are isolated from the plurality of nozzles and which are formed in the recessed surface, wherein the actuator unit has (b-1) a piezoelectric sheet straddling the plurality of first recesses, (b-2) a plurality of individual electrodes located in positions opposed to the respective first recesses, and (b-3) a common electrode cooperating with each of the individual electrodes to define a portion of the piezoelectric sheet which is located between the common electrode and the each of the individual electrodes. The actuator unit is fixed to the recessed surface of the ink channel unit by an adhesive, such that the first recesses are closed by the actuator unit so as to provide respective pressure chambers. It is preferable that the first and second recesses are positioned relative to each other such that each of the first recesses is accompanied by at least one of the second recesses, namely, such that at least one of second recesses is positioned in the vicinity of each of the first recesses.

The construction according to this first aspect of the invention permits, in a process of bonding the ink channel unit and the actuator unit by applying the adhesive onto the recessed surface of the ink channel unit, it is possible to cause a part of the applied adhesive to flow into the second recesses, thereby advantageously reducing an amount of the adhesive which flows into the first recesses. It is therefore possible to increase a permissible upper limit of amount of the applied adhesive, thereby eliminating necessity of strictly controlling the applied adhesive amount.

The second aspect of the invention provides an inkjet head including a laminar structure including a plurality of plates superposed on each other, wherein the plurality of plates includes a first plate having an opening defining surface which defines a plurality of first openings and a plurality of second openings. The first openings are held in communication with a plurality of nozzles which are defined in an end-most one of the plurality of plates, while the second openings are isolated from the plurality of nozzles. The plurality of plates includes a second plate fixed to the opening defining surface of the fist plate by an adhesive.

The construction according to this second aspect of the invention permits, in a process of bonding the first plate and second pate by applying the adhesive onto the opening defining surface of the first plate, a part of the applied adhesive to flow into the second openings, thereby advantageously reducing an amount of the adhesive which flows into the first openings.

The third aspect of the invention provides an inkjet head according to the first or second aspect of the invention, manufactured by a process including a moving step of moving at least one of an adhesive applier and the recessed or opening defining surface of the ink channel unit relative to the other of the adhesive applier and the recessed or opening defining surface, while forcing at least one of the adhesive applier and the recessed or opening defining surface against the other of the adhesive applier and the recessed or opening defining surface, wherein the at least one of the adhesive applier and the recessed or opening defining surface is moved in a direction that causes the adhesive applier to pass each of the first recesses or openings after passing a corresponding one of the second recesses or openings.

The process may be carried out by using a plate as the adhesive applier and a flexible sheet having an adhesive deposited on its surface, wherein the moving step is implemented by causing the flexible sheet to be forced by an edge of the plate onto the recessed or opening defining surface of the ink channel unit, such that the flexible sheet is brought into pressing contact at the surface with the recessed or opening defining surface, whereby the adhesive deposited on the surface is transferred onto the recessed or opening defining surface.

BRIEF DESCRIPTION OF THE DRAWINGS

The above and other objects, features, advantages and technical and industrial significance of the present invention will be better understood by reading the following detailed description of presently preferred embodiment of the invention, when considered in connection with the accompanying drawings, in which.

DETAILED DESCRIPTION OF THE PREFERRED EMBODIMENTS

Figure 1:
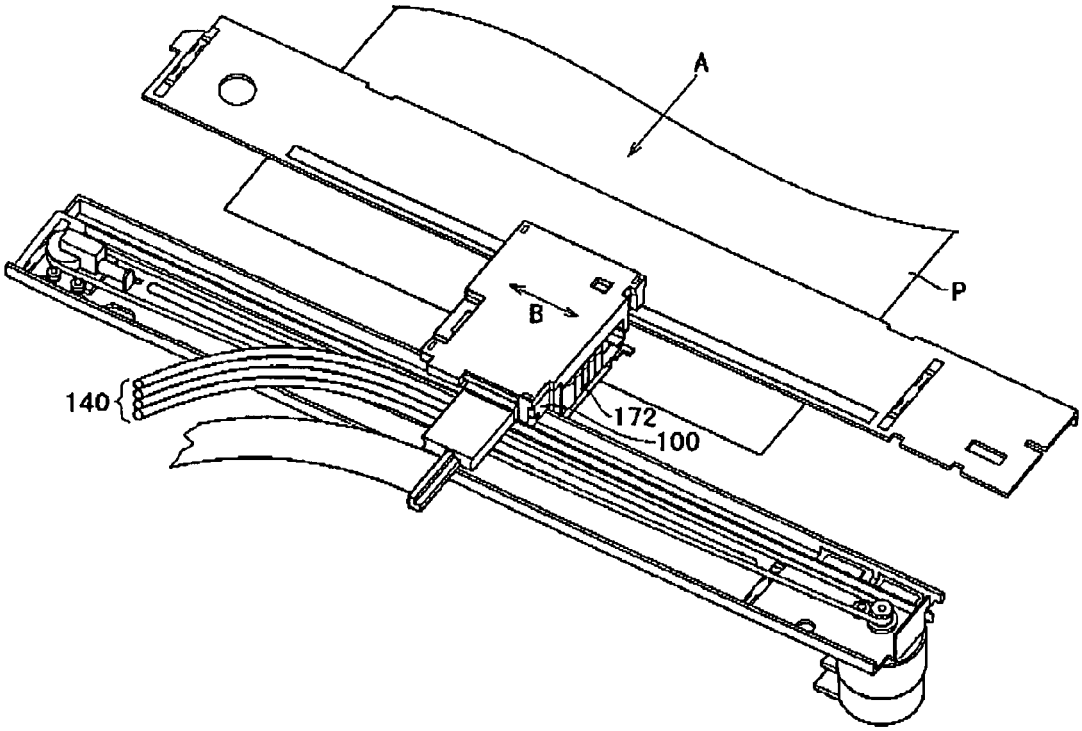
FIG. 1 is a perspective view showing a part of an inkjet printer equipped with an inkjet head which is held by a holder mounted on a carriage and which is constructed according to an embodiment of the invention.

FIG. 1 is a perspective view showing a part of an inkjet printer equipped with two inkjet heads 1, each of which is constructed according to an embodiment of the invention for performing a recording operation onto a paper sheet P as a recording medium. In the recording operation, as shown in FIG. 1, the inkjet head 1 is operable to eject ink droplets onto the paper sheet P which is fed in a direction as indicated by arrow A, while being reciprocated in a width direction of the paper sheet P as indicated by arrow B, so that a desired image is formed or recorded on the paper sheet P. The inkjet head 1 is fixedly held by a holder 172 which is detachably mounted on a carriage 100. Four color inks such as magenta, yellow, cyan and black inks are supplied to the holder 172 via respective ink tubes 140, for enabling the inkjet head 1 to perform a full color printing operation.

Figure 2:
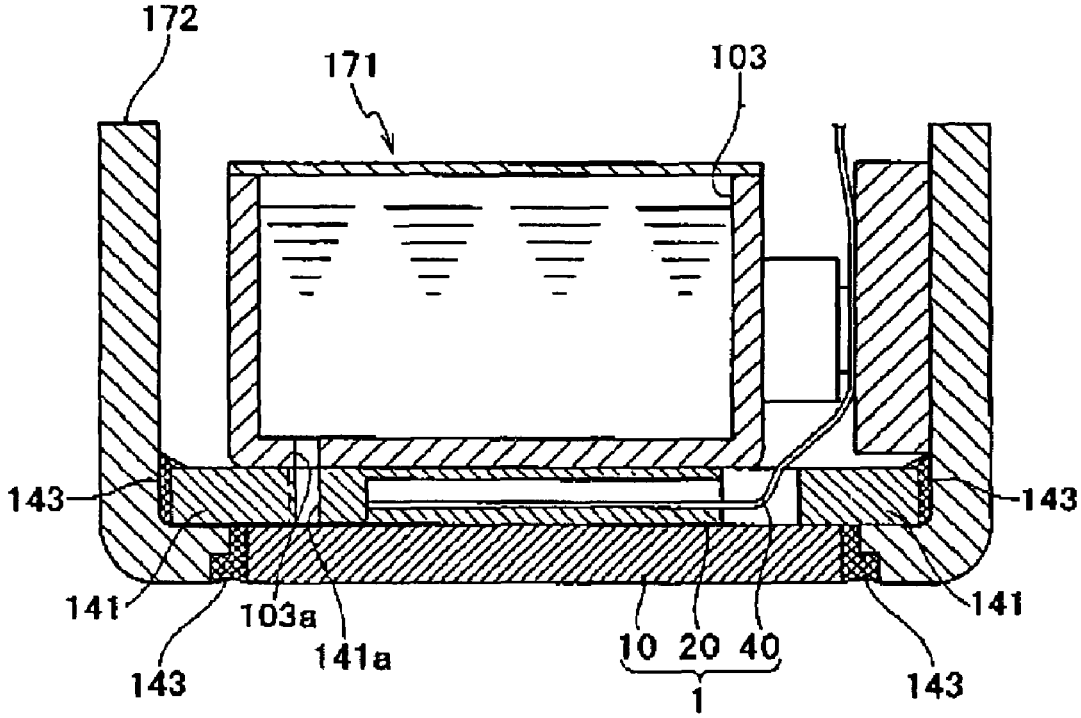
FIG. 2 is a cross sectional view of the inkjet head held by the holder through a frame which is fixed to the inkjet head.
Figure 3:
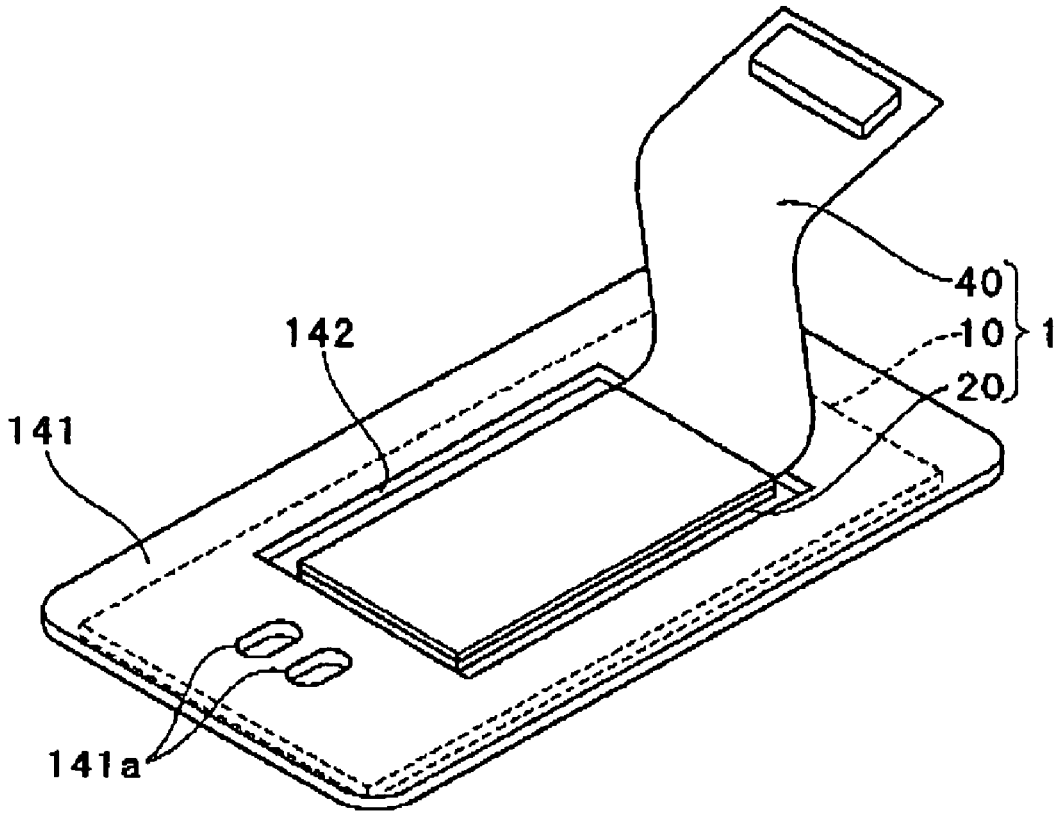
FIG. 3 is a perspective view showing an image forming portion of the inkjet printer incorporating therein the inkjet head.

An ink tank 171 is detachably mounted on the holder 172, as shown in FIG. 2. The ink tank 171 defines an ink chamber 103 partitioned into four sections into which the four color inks are supplied via the ink tubes 140. The supplied four color inks are temporarily stored in the ink chamber 103. Below the ink tank 171, there are disposed the two inkjet heads 1 each of which is arranged to eject two color inks. As shown in FIG. 3, each of the inkjet heads 1 is bonded to a frame 141 having a rectangular shape in its plan view. The inkjet head 1 is fixed through the frame 141 to a bottom surface of the holder 172 having a generally oblong rectangular shape. An ultraviolet curing adhesive 143 is provided to close a clearance or gap between the holder 172 and the frame 141 which is fixed to the inkjet head 1, for avoiding entrance of dust and ink mist through the gap from the exterior. To the frame 141, there is fixed an ink channel unit 10 of the inkjet head 1 such that an actuator unit 20 is disposed within an oblong rectangular-shaped aperture 142 which is formed through the frame 141. An ink outlet 103*a* is formed through a bottom wall of the ink tank 171, so as to be held in communication with the ink chamber 103. A through-hole 141*a* having an elliptic shape in its cross section is formed through a portion of the frame 141 which is aligned with the ink outlet 103*a*. The through-hole 141*a* of the frame 141 is held in communication with an inside of the ink channel unit 10. With the ink tank 171, frame 141 and inkjet head 1 being thus fixed to the holder 172, an ink channel is defined such that the ink stored in the ink chamber 103 can be supplied to the corresponding inkjet head 1 via the ink channel.

Figure 4:
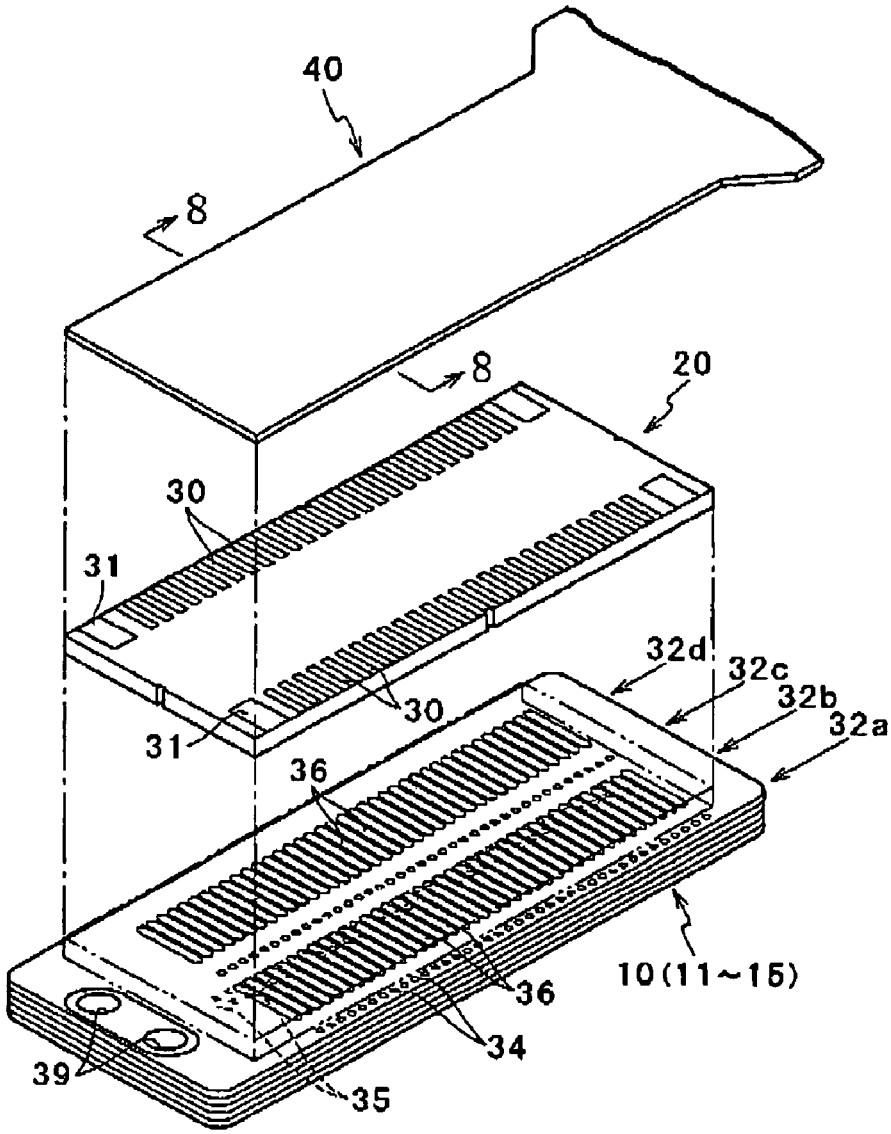
FIG. 4 is a perspective and exploded view of the inkjet head.

As shown in FIG. 4, the inkjet head 1 has the ink channel unit 10 and the actuator unit 20 which is fixed to a surface of the ink channel unit 10 by an adhesive. Onto an upper surface of the actuator unit 20, a flexible flat cable 40 is connected for establishing an electric connection of the actuator unit 20 with a drive IC (not shown).

Figure 5:
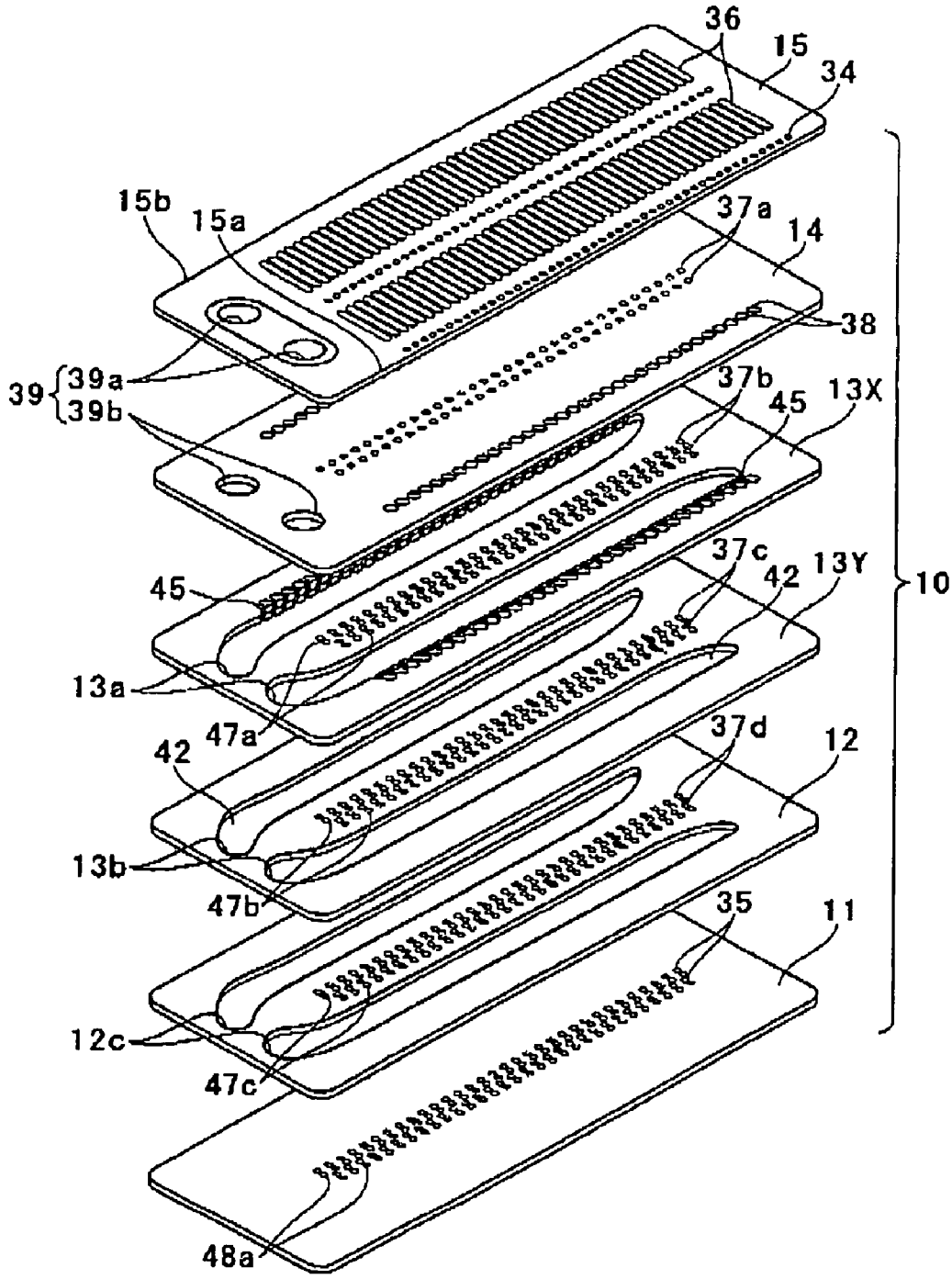
FIG. 5 is a perspective and exploded view of an ink channel unit which is included in the inkjet head.
Figure 6:
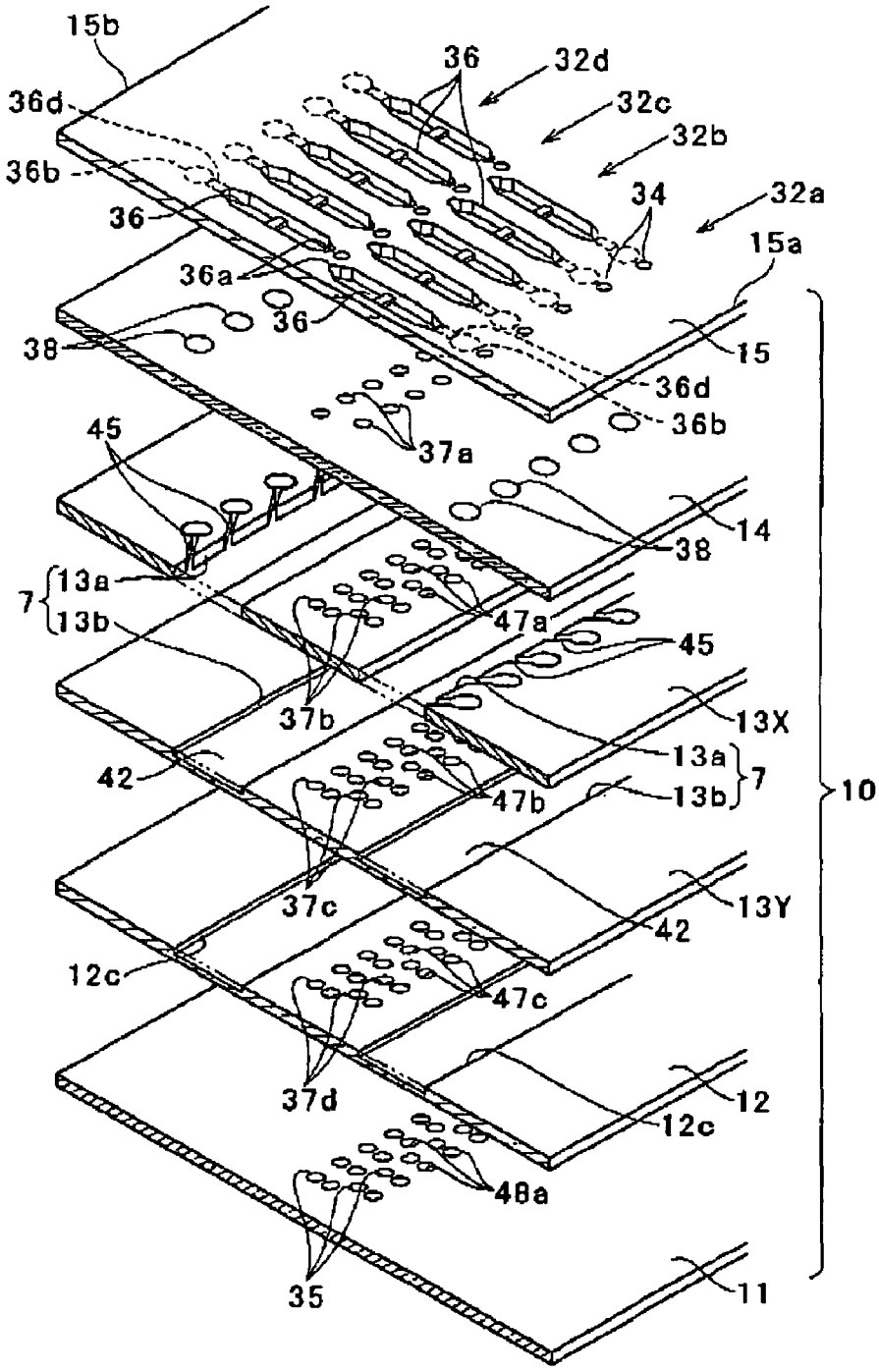
FIG. 6 is a perspective and exploded view of a part of the ink channel unit of FIG. 5.

As shown in FIGS. 5 and 6, the ink channel unit 10 is a laminar structure consisting of a total of six thin metallic plates superposed on each other and bonded together by an adhesive. The six plates consist of a nozzle plate 11, a damper plate 12, two manifold plates 13X, 13Y, a spacer plate 14, and a base plate 15. The six plates 11-15 are arranged in the order of description, with the nozzle plate 11 and the base plate 15 being a lowermost plate and an uppermost plate of the ink channel unit 10, respectively.

In the nozzle plate 11, there are formed a multiplicity of nozzles 35 through which the ink is to be ejected toward the recording medium. The nozzles 35 are spaced apart from each other by a predetermined distance, and are arranged in two rows extending in a longitudinal direction of the nozzle plate 11. The nozzles 35 arranged in the two rows cooperate to form a zigzag pattern.

In the base plate 15, there are formed a multiplicity of through-holes 36. The through-holes 36 are arranged in two rows extending in a longitudinal direction of the base plate 15, and cooperate to form a zigzag pattern. Each of the through-holes 36 is closed at upper and lower openings by the actuator unit 20 and the spacer plate 14, respectively, so as to provide a pressure chamber having a desired volume. In the following description, therefore, the reference numeral "36" denotes the pressure chamber as well as the through-hole.

Each of the pressure chambers 36 has, in a plan view of the base plate 15, a generally oblong rectangular shape with its longitudinally opposite end portions each of which is rounded to have a predetermined radius of curvature. The pressure chambers 36 are elongated in a direction perpendicular to the longitudinal direction of the base plate 15. The pressure chambers 36 are accompanied by respective columnar-shaped capture holes 34 whose number is equal to the number of the pressure chambers 36. Each of the capture holes 34 is located between a corresponding one of the pressure chambers 36 and one 15*a* of opposite long sides of the base plate 15, and is distant from one of longitudinally opposite ends (that is closer to the long side 15*a* of the base plate 15) of the corresponding pressure chamber 36 by a constant distance as measured in the longitudinal direction of the corresponding pressure chamber 36. In other words, each of the pressure chambers 36 (as first recesses) and a corresponding one of the capture holes 34 (as second recesses) cooperate with each other to constitute a pair of recesses, so that the pressure chambers 36 and the capture holes 34 constitute a plurality of pairs of recesses, which are the same with respect to a direction and a distant in and by which each pressure chamber 36 and the corresponding capture hole 34 are distant from each other. The capture holes 34 are arranged in two rows 32*b* ,32*d* extending in the longitudinal direction of the base plate 15, the four rows 32*a* 32*b* 32*c* 32*b* are arranged in the order of prescription as viewed in a direction away from the above-described one 15*a* of the opposite long sides toward the other long side 15*b*.

As shown in FIG. 4, the actuator unit 20 is fixed to a surface of the base plate 15, i.e., a recessed surface of the ink channel unit 10 in which the holes 34, 36 open. The actuator unit 20 closes one of opposite openings of each of the holes 84, 36 belonging to the three rows 32*b*, 32*c*, 32*d* that are closer to the above-described other long side 15*b* than the row 32*a*, but does not close one of opposite openings of each of the holes 34 belonging to the row 32*a* that is the closest to the long side 15*a*. That is, the actuator unit 20 is bonded to the base plate 15 such that an intersection 20*a* of a side wall of the unit 20 (defining a long side of the unit 20) and the recessed surface of the ink channel unit 10 lies between the row 32*a* (that is the closest to the long side 16*a*) and the row 32*b* (that is adjacent to the row 32*a*), and extends in the longitudinal direction of the ink channel unit 10 (see FIGS. 7A and 7B).

Figure 7A:
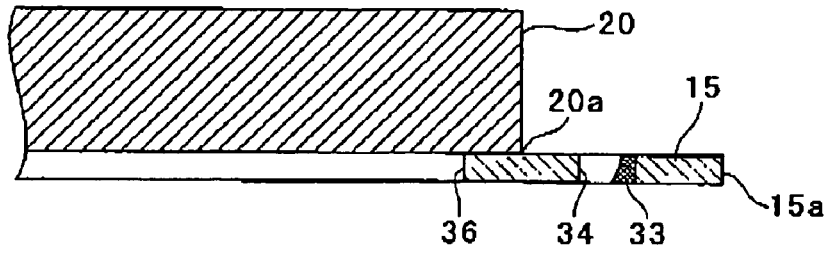
FIG. 7A is a cross sectional view of a part of the ink channel unit of FIG. 5, taken in a plane parallel to a width direction of the ink channel unit.
Figure 7B:
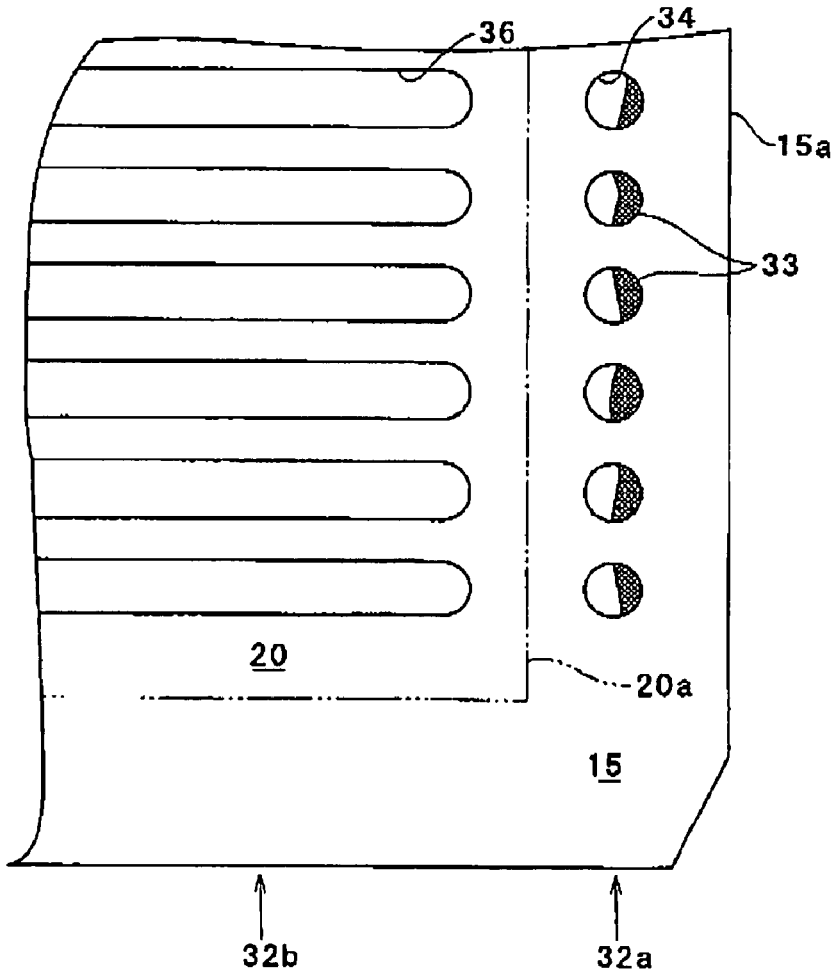
FIG. 7B is a plan view of a part of the ink channel unit of FIG. 5.

FIG. 7A is a cross sectional view of a part of the base plate 15, taken in a plane parallel to a width direction of the ink channel unit 10, while FIG. 7B is a plan view of a part of the ink channel unit 10. In FIG. 7B, the intersection of the side wall of the actuator unit 20 and the recessed surface of the ink channel unit 10 is represented by two-dot chain line. As is apparent from FIG. 7B, the capture holes 34 have a diameter that is substantially equal to a width of the pressure chambers 36, so that each of the capture holes 34 has, in one of opposite portions that is more distant from a corresponding one of the pressure chambers 36 than the other portion of each of the capture holes 34, a curvature substantially equal to a curvature of one of opposite portions of the corresponding one of the pressure chambers 36 that is closer to each of the capture holes 34 than the other portion of the corresponding one of the pressure chambers 36.

The capture holes 34 belonging to the row 32*a* (that is the closest to the long side 15*a*) are same in that each capture hole 34 is partially filled with an adhesive 33. Specifically, each of the holes 34 of the row 32*a* is filled, at its part that is about half of its entirety and that is relatively close to the long side 15*a*, with the adhesive 33. On the other hand, within the pressure chambers 36, there is not substantially exist the adhesive 33. It is noted that the adhesive 33 used for bonding the ink channel unit 10 and the actuator unit 20 is applied onto the base plate 15. The thus applied adhesive 33 forms a thin layer (not shown) on the surface of the base plate 15 opposed to the actuator unit 20.

Referring back to the FIG. 6, groove-shaped restricted passages 36*d* and ink supply holes 36*b* are formed in a surface of the base plate 15 which is held in contact with the spacer plate 14. Each of the groove-shaped restricted passages 36*d* is connected at its opposite ends with a corresponding one of the pressure chambers 36 and a corresponding one of the ink supply holes 36*b*. The pressure chambers 36 are held in communication, at their respective end portions 36*a* which are located in a widthwise central portion of the base plate 15, with respective nozzles 15 via through-holes 37*a*, 37*b*, 37*c*, 37*d*, which are formed through the spacer plates 14, two manifold plates 13X, 13Y and damper plate 12 and arranged in respective zigzag patterns.

Figure 8:
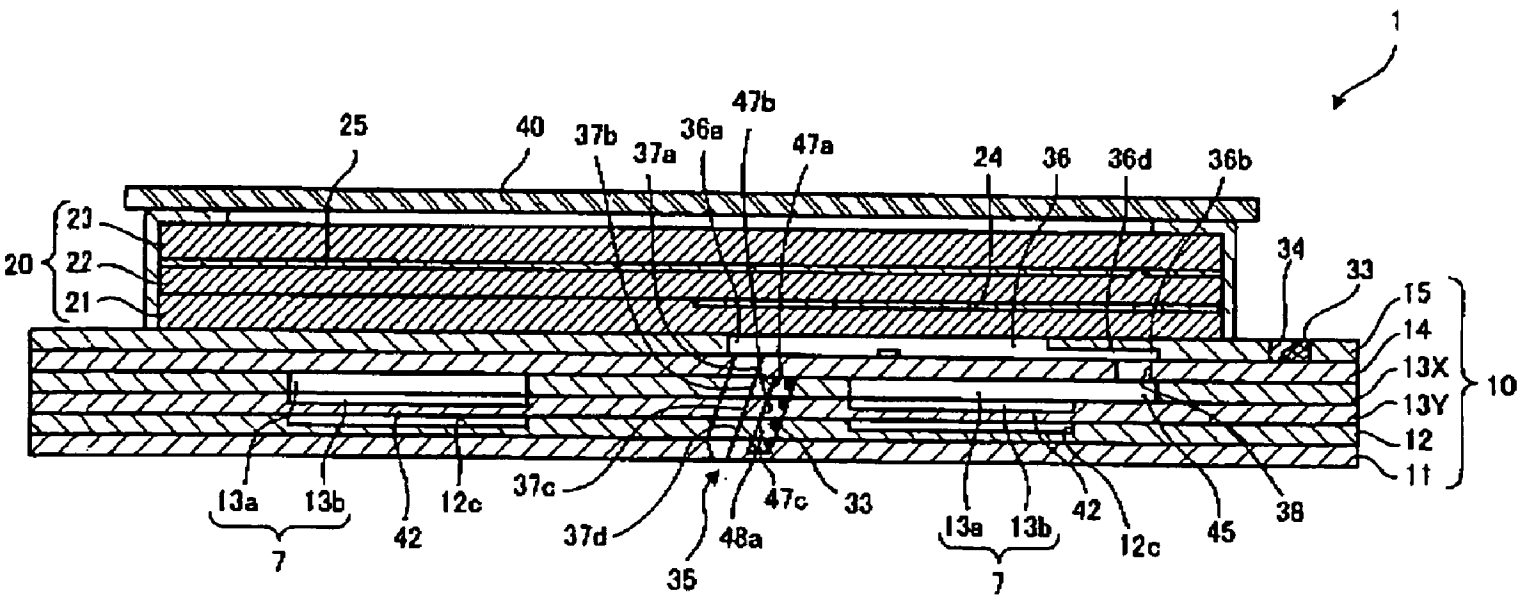
FIG. 8 is a cross sectional view taken along line 8-8.

Each of the through-holes 37*b*, 37*c*, 37*d* formed through the manifold plates 13X, 13Y and damper plate 12 is accompanied by a corresponding one of columnar-shaped capture holes 47*a*, 47*b*, 47*c* which are also formed through the plates 13X, 13Y, 12. Each of the capture holes 47*a*, 47*b*, 47*c* is located between a corresponding one of the through-holes 37*b*, 37*c*, 37*d* and the long side 15*a*, and is distant from a corresponding one of through-hole 37*b*, 87*c*, 37*d* by a constant distance. Similarly, each of the nozzles 35 formed through the nozzle plate 11 is accompanied by a corresponding one of columnar-shaped capture recesses 48*a* which are also formed in the nozzle plate 11 so as to open toward the base plate 15 in a direction in which the six plates 11-15 are superposed, such that each of the capture recesses 48*a* is located between a corresponding one of the nozzles 35 and the long side 16*a*, and is distant from the corresponding nozzle 35 by a constant distance. Each of the capture recesses 48*a* and the corresponding capture holes 47*a*, 47*b*, 47*c* are held in communication, so as to cooperate to form a vertically elongated recess having a large aspect ratio and closed at its open end by the spacer plate 14, as shown in FIG. 8 that is a cross sectional view taken in a plane parallel to a width direction of the inkjet head 1.

The capture holes 47*a*, 47*b*, 47*c* and recesses 48*a* have a diameter that is substantially equal to a diameter of the through-holes 37*b*, 37*c*, 37*a* and nozzles 35, respectively. Therefore, each of the capture holes 47*a*, 47*b*, 47*c* and recesses 48*a* has, in one of opposite portions that is more distant from a corresponding one of the through-holes 37*b*, 37*c*, 37*a* and nozzles 35 than the other portion of each of the capture holes 47*a*, 47*b*, 47*c* and recesses 48*a*, a curvature substantially equal to a curvature of one of opposite portions of the corresponding one of the through-holes 37*b*, 37*c*, 37*a* and nozzles 35 that is closer to each of the capture holes 47*a*, 47*b*, 47*c* and recesses 48*a* than the other portion of the corresponding one of the through-holes 37*b*, 37*c*, 37*a* and nozzles 35.

The capture holes 47*a*, 47*b*, 47*c* and recesses 48*a* are same in that each hole or recess is filled, at its part that is relatively close to the long side 15*a*, with the adhesive 33 which is used for bonding the plates of the ink channel unit 10 to each other. On the other hand, within the through-holes 37*b*, 37*c*, 37*a* and nozzles 35, there is not substantially exist the adhesive 33. It is noted that a thin layer (not shown) formed of the applied adhesive 33 is interposed between each adjacent pair of the plates of the ink channel unit 10.

Two apertures 13*a* are formed through the manifold plate 13X, ie., one of the two manifold plates that is closer to the spacer plate 14. Each of the two apertures 13*a* constitutes an upper part of a common chamber. In a side wall of each of the two apertures 13*a*, groove-shaped passages 45 are formed to constitute connection passages which are held in communication with the respective ink supply holes 36*b*. In the manifold plate 13Y, i.e., the other of the two manifold plates that is closer to the nozzle plate 11, two recesses 13*b* are formed to open only toward the adjacent manifold plate 13X. Each of the two recesses 13*b* constitutes a lower part of the common chamber. With the two manifold plates 13X, 13Y and spacer plate 14 being laminated on each other, as shown in FIG. 8, there are provided two common ink chambers 7 each constituted by the corresponding aperture 13*a* and recess 13*b* which are superposed on each other. The two common chambers 7 are located on opposite sides of the rows of the through-holes 37*a*-37*d*, and are elongated in parallel to the rows of the through-holes 37*a*, 37*d*.

In the damper plate 12, two damper recesses 12*c* are formed to open only toward the manifold plate 13Y The damper recesses 12*c* are aligned with and have the same shape as the common chambers 7 as viewed in the plan view of the ink channel unit 10. As shown in FIG. 5, two ink supply holes 39*a* are formed through a longitudinally end portion of the base plate 15, while two ink supply holes 39*b* are formed through a longitudinally end portion of the spacer plate 14. The ink supplied from the exterior of the inkjet head 1 can be delivered to the two common chambers 7 via the ink supply holes 39*a*, 39*b*. A multiplicity of ink supply holes 38 are formed through widthwise opposite end portions of the spacer plate 14, so that the ink can be distributed from the common chambers 7 to the pressure chambers 36 via the ink supply holes 38.

In the ink channel unit 10 constructed as described above, there are formed a multiplicity of individual ink channels (hereinafter simply referred to as "channels Ch" where appropriate) each of which is defined by the corresponding common chamber 7, connection passage 45, ink supply hole 38, restricted passage 36*d*, pressure chamber 36 and nozzle 35. In the present embodiment, the number of the individual ink channels is 75 (Ch0-Ch74) In each individual ink channel upon application of ejection energy to the ink within the corresponding pressure chamber 36 by activation of the actuator unit 20, the ink is delivered through the corresponding through-holes 37*a*-37*d* to the corresponding nozzle 35, so that the ink is ejected from the nozzle 35.

Figure 9:
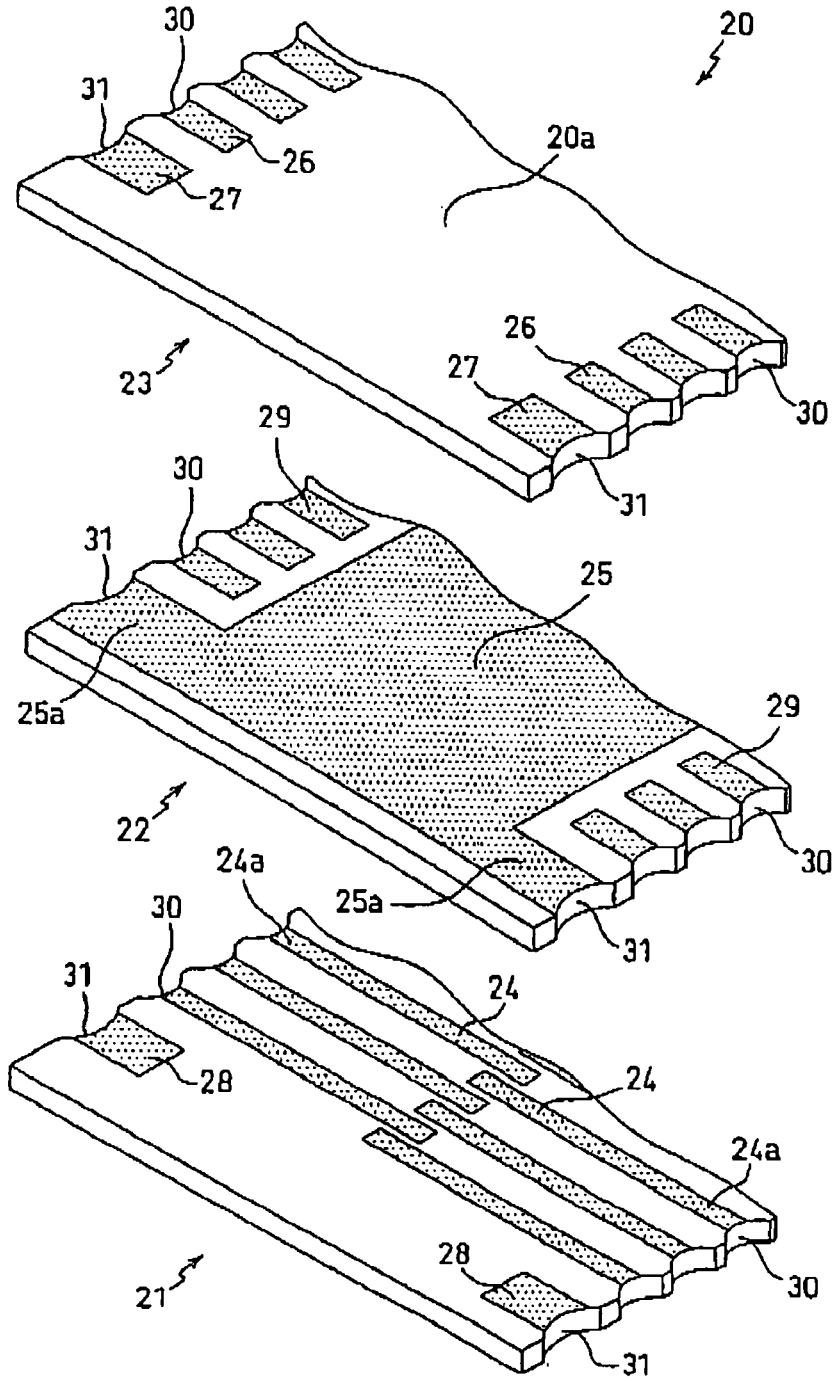
FIG. 9 is a perspective and exploded view of a part of an actuator unit which is included in the inkjet head.

As shown in FIGS. 8 and 9, the actuator unit 20 is a laminar structure consisting of three sheets, i.e., two piezoelectric sheets 21, 22 and an insulating sheet 23. On the upper surface of the piezoelectric sheet 21, a multiplicity of individual electrodes 24 are disposed in respective positions which are opposed to the respective pressure chambers 36 of the ink channel unit 10. Each of the individual electrodes 24 has an end 24*a* reaching a side surface of the actuator unit 20.

On the upper surface of the other piezoelectric sheet 22, a common electrode 25 is disposed to straddle the multiplicity of pressure chambers 36. The common electrode 25 has an end 25*a* which reaches the side surface of the actuator unit 20 like the end 24*a* of each individual electrode 24. The common electrode 15, which is constantly held in electrically ground level, cooperates with each individual electrode 24 to define an active portion (pressure generator portion) of the piezoelectric sheet 22 that is located therebetween, so that a deformation of the active portion causes a pressure to be applied to the ink within the corresponding pressure chamber 36. On an upper surface of the insulating sheet 23, ie., an uppermost one of the three sheets of the actuator unit 20, surface electrodes 26, 27 are provided to be arranged in two rows, such that each surface electrode 26 is connected to the corresponding individual electrode 24 while each surface electrode 27 is connected to the common electrode 27.

In widthwise opposite side walls of the actuator unit 20 extending in a longitudinal direction of the unit 20, there are formed a multiplicity of first grooves 30 and two second grooves 31, such that a side electrode is disposed in each of the grooves 30, 31 which extend in a thickness direction of the unit 20. Each one of the two second grooves 31 is located on a side of an end of a corresponding row of the first grooves 30 which are arranged to correspond to the respective individual electrodes 24. The side electrode disposed in each of the first grooves 30 is held in contact with the end 24*a* of the corresponding individual electrode 24 and the corresponding surface electrode 26, so that the individual electrode 24 and the surface electrode 26 are electrically connected to each other. The side electrode disposed in each of the second grooves 31 is held in contact with the corresponding end 25*a* of the common electrode 25 and the corresponding surface electrode 27, so that the common electrode 25 and the surface electrode 27 are electrically connected to each other. It is noted that dummy electrodes 28, 29 (each of which is not particularly for an electrical use) are also provided in the actuator unit 20. The provision of the dummy electrodes 28, 29 serves to equalize thickness values of portions of the actuator unit 20 in which the ends 24*a*, 25*a* of the electrodes 24, 25 are located, so that the actuator unit 20 is made flattened as a whole.

As is apparent from FIG. 8, the ink channel unit 10 and the actuator unit 20 are bonded to each other such that the pressure chambers 36 of the ink channel unit 10 are opposed to the respective individual electrodes 24 of the actuator unit 20. On the upper surface of the actuator unit 20, the surface electrodes 26, 27 are electrically connected to the flexible flat cable 40. Each of the individual electrodes 24, which is opposed to the corresponding pressure chamber 36, cooperates with the common electrode 25, piezoelectric sheets 21, 22 and insulating sheet 23 to constitute a piezoelectric actuator operable to eject the ink droplet from the corresponding nozzle 35.

In the inkjet head 1 constructed as described above, with application of a voltage between a selected one of the individual electrodes 24 and common electrode 25, the active portion of the piezoelectric sheet 22 opposed to the selected individual electrode 24 is strained or deformed due to a piezoelectric effect in a thickness direction of the sheet 22, so as to be convexed toward the corresponding pressure chamber 36. In an initial stage of operation, the volume of the pressure chamber 36 is thus reduced by the convexed deformation of the active portion. The voltage between the individual electrode 24 and common electrode 25 is once reduced to a ground level, and is then increased to a predetermined positive level at a predetermined point of time. The ink is ejected from the corresponding nozzle 35 upon increase of the applied voltage to the positive level. It is noted that the number of active layer or layers constituting the active portions does not have to be one as in the present embodiment, but may be two or more. That is, the number of the active layers may be determined depending upon a required amount of the deformation (displacement) of the actuator unit 20.

Figure 10:
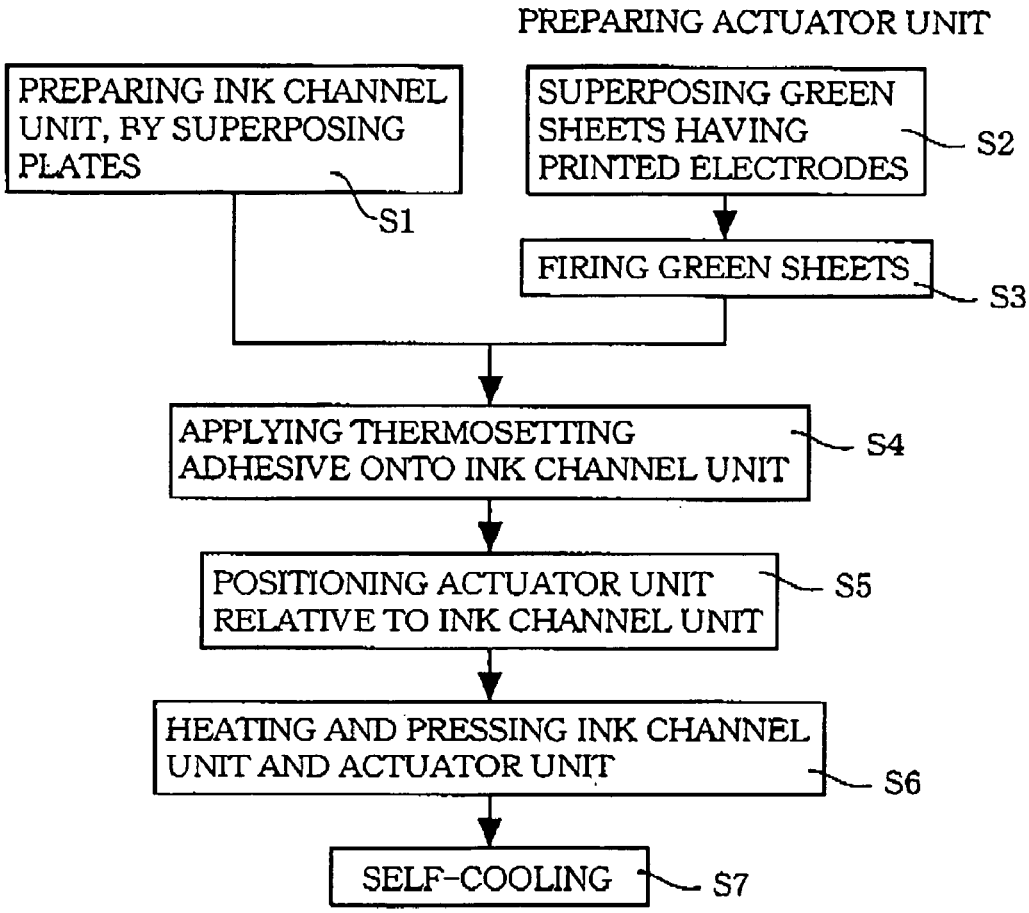
FIG. 10 is a flow chart showing steps of a process of manufacturing the inkjet head.
Figure 11:
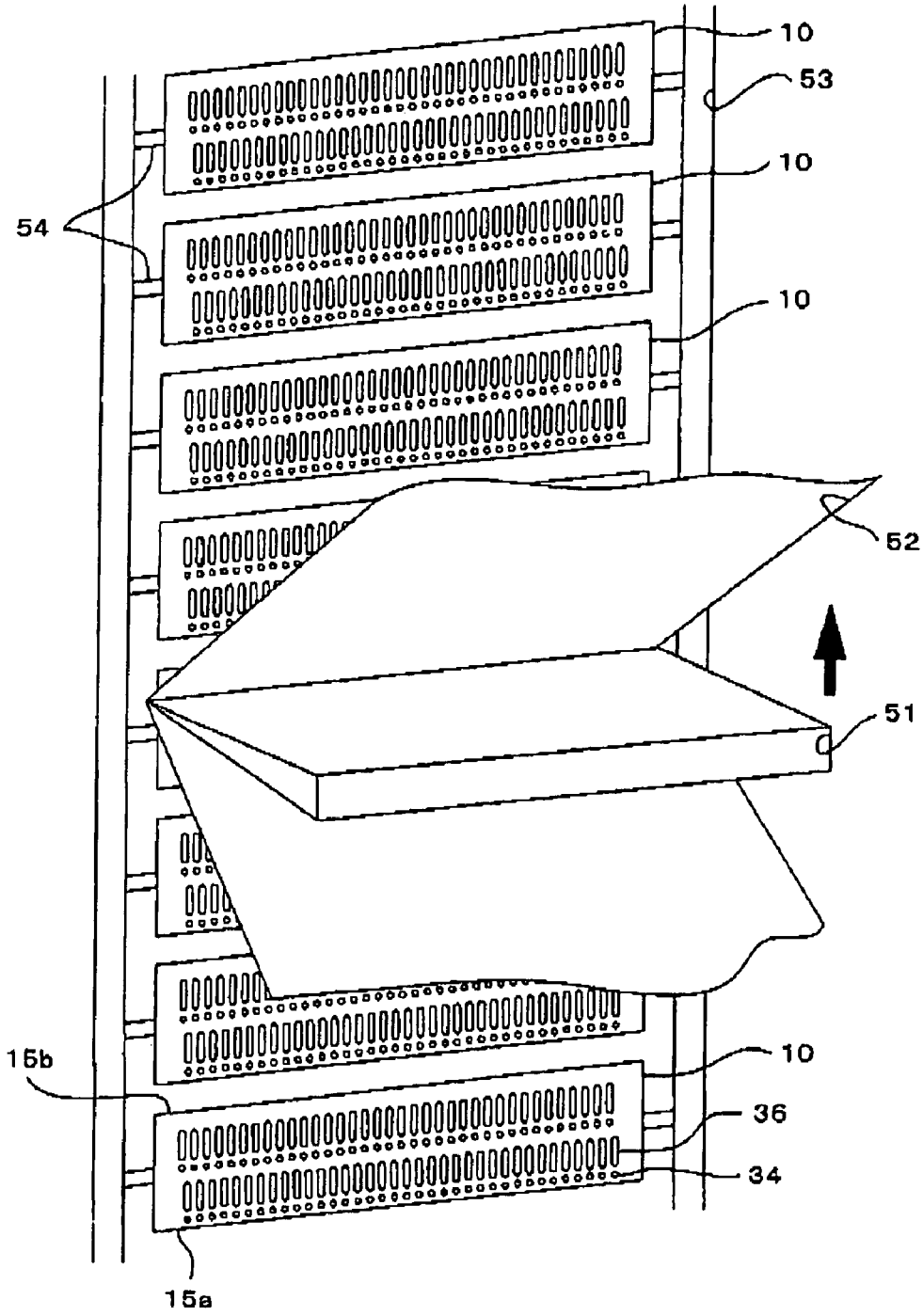
FIG. 11 is a view schematically showing an operation to apply an adhesive onto a plurality of ink channel units which are arranged in a row.
Figure 12:
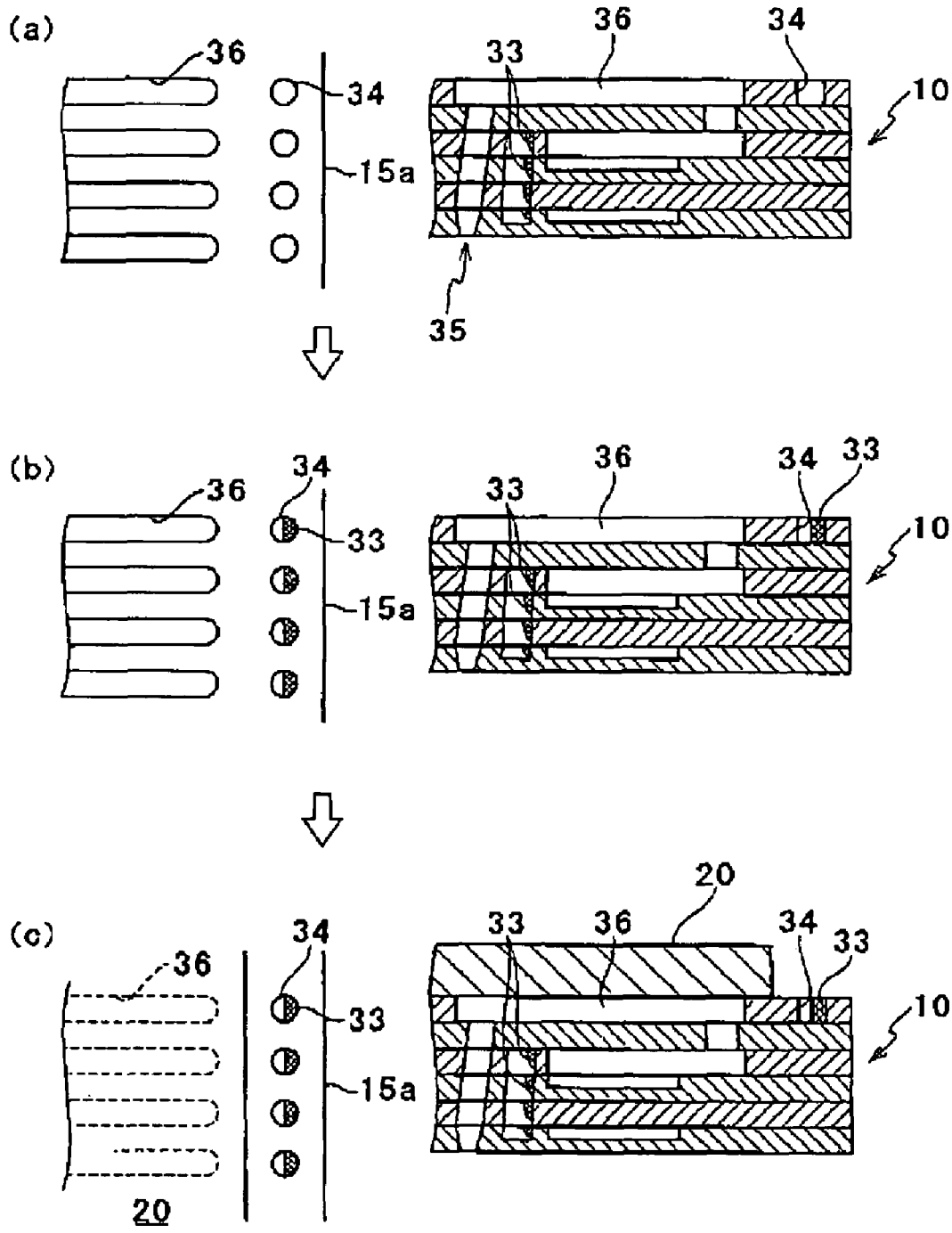
FIG. 12 is a set of views showing a process in which the actuator unit is bonded to the ink channel unit.

Referring next to FIGS. 10-12, there will be described a process of manufacturing the inkjet head 1. As shown in a flow chart of FIG. 10, the ink channel unit 10 and the actuator unit 20 are prepared independently of each other, and then the two units 10, 20 and other components are assembled into the inkjet head 1.

The manufacturing process is initiated with step S1 which is implemented to prepare the ink channel unit 10. In step S1, each of the plates 11, 12, 13X, 13Y, 14, 15 is subjected to an etching or half-etching operating carried out by using a masking member in the form of patterned photoresist, such that through-holes and/or recesses are formed in each plate 11, 12, 13X, 13Y, 14, 15. The thus holed and/or recessed plates 11, 12, 13X, 13Y, 14, 15 are fixed together, by applying a thermosetting adhesive such as an epoxy bond onto at least one of opposed surfaces of each adjacent pair of the plates 11, 12, 13X, 13Y, 14, 15, in accordance with a transfer method as shown in FIG. 11. For example, the plates 14 and 15 can be bonded to each other by applying a surface of the plate 15. In this stage, the adhesive is not yet applied on another surface of the plate 15 corresponding to the above-described recessed surface of the ink channel unit 10 at which the plate 15 is to be bonded to the actuator unit 20. When the six plates 11, 12, 13X, 13Y, 14, 15 are superposed on each other, the plates 11, 12, 13X, 13Y, 14, 15 are positioned relative to each other, such that the bonded plates 11, 12, 13X, 13Y, 14, 15 cooperate to define the individual ink channels each of which is constituted by the corresponding ink supply hole 39, common chamber 7, connection passage 45, ink supply hole 38, restricted passage 36*d*, pressure chamber 36 and nozzle 35. The superposed plates 11, 12, 13X, 13Y, 14, 15 are then pressed while being heated at a temperature not lower than a setting temperature of the thermosetting adhesive. With the thermosetting adhesive being cured, the ink channel unit 10 as shown in FIG. 4 is obtained. While the plates 11, 12, 13X, 13Y, 14, 15 are fixed by the adhesive in the present embodiment, they may be fixed by other means such as metal welding instead of using the adhesive. Further, the holes of the nozzle plate 11 does not necessarily have to be formed by etching, but may be formed by punching or laser machining.

FIG. 12 is a set of views showing a process in which the actuator unit 20 is bonded to the ink channel unit 10. A part of the ink channel unit 10 prepared by step S1 is shown in a plan view (left) and a cross sectional view (right) at (a) of FIG. 12. As shown in the plan view, the capture holes 34 are arranged in a row adjacent to the long side 15*a* of the ink channel unit 10. When the adhesive (for bonding the actuator unit 20 to the ink channel unit 10) is applied onto the recessed surface of the ink channel unit 10, the adhesive is expanded away from the long side 15*a* toward the pressure chambers 36. That is, the capture holes 34, which are located between the long side 15*a* and the row of the pressure chambers 36, are located on an upstream side of the pressure chambers 36. As shown in the cross sectional view at (a) of FIG. 12, each of the capture holes 47*a*, 47*b*, 47*c* and capture recess 48*a* is filled, at its part which is relatively close to the long side 15*a* and which is about half of its entirety, with the adhesive 33 applied onto the upper surface of each plate for bonding together the plates of the ink channel unit 10. In other words, the applied adhesive 33 is captured at the above-described part of each of the capture holes 47*a*, 47*b*, 47*c* and capture recess 48*a*, while the adhesive 33 little flows into the through-holes 37*a*, 37*b*, 37*c*, 37*d* and nozzles 35, for the same reason that the adhesive 33 is captured only at a part of each of the capture holes 34 which is relatively close to the long side 16*a* and which is about half of its entirety. It is noted that the bonding of the plates 14 and 15 is made by applying the adhesive 33 onto the lower surface of the plate 15 rather than onto the upper surface of the plate 14 in the present embodiment. In application of the adhesive 33 onto the lower surface of the plate 15, the adhesive 33 is restrained from flowing into the pressure chambers 36, owing to the capture holes 34 located adjacent to the long side 15*a* and opening in the lower surface of the plate 15 as well as in the upper surface of the plate 15.

For preparing the actuator unit 20, step S2 is first implemented to perform a screen printing operation by which a conductive paste as precursor of the individual electrodes 24, common electrode 25, surface electrodes 26, 27 is printed on green sheets formed of piezoelectric ceramic. After the screen printing operation, the green sheet having the printed paste as the precursor of the common electrode 25 is superposed on the green sheet having the printed paste as the precursor of the individual electrodes 24, and then the green sheet having the printed paste as the precursor of the surface electrodes 26, 27 is superposed on the green sheet having the printed paste as the precursor of the common electrode 25. The relative position among the superposed three green sheets as a laminar structure is adjusted by using a suitable jig.

Step S2 is followed by step S3 which is implemented to degrease the laminar structure (obtained in step S2) in the same manner in which a known ceramic material is degreased. After having been degreased, the laminar structure is fired at a predetermined temperature, whereby the actuator unit 20 as shown in FIG. 4 is obtained. It is noted that the green sheets as a precursor of the actuator unit 20 are prepared by taking account of an amount of shrinkage occurred in the firing process. It is further noted that the side electrodes exposed on the side surfaces of the actuator unit 20 may be printed in the same manner as the printing of the individual electrodes 24, common electrode 25 and surface electrodes 26, 27 which are to be connected by the side electrodes. The side electrodes may be formed together with the other electrodes 24-27 before the firing process of step S3, or alternatively, may be formed after the firing process.

Further, since the ink channel unit preparing process consisting of step S1 and the actuator unit preparing process consisting of steps S2 and S3 are carried out independently of each other, either one of the two processes may be carried out prior to the other process, or the two processes may be carried out concurrently with each other.

Step S4 is implemented to apply an adhesive onto a recessed surface (or opening defining surface) of the ink channel unit 10 (obtained in step S1) in which a multiplicity of recesses corresponding to the pressure chambers 36 and capture holes 34 are formed (or in which openings of the multiplicity of recesses are defined). The applied adhesive is an epoxy thermosetting adhesive having a setting temperature of about 80° C., and may be of two-liquid mixing type.

FIG. 11 is a view schematically showing an operation of step S4 in which the adhesive is being applied onto a plurality of ink channel units 10 (each prepared in step S1), which are arranged in a row extending in a width direction of each of the ink channel units 10. The ink channel units 10 are fixed relative to each other by a rod frame consisting of by a pair of main rods 53 located on opposite sides of the row of the units 10 and extending in parallel to the row of the units 10, and a plurality of pairs of auxiliary rods 54 extending from the rods 53 in perpendicular to the row of the units 10 and arranged in parallel to the row of the units 10 at a constant spacing interval Each ink channel unit 10 is fixed at its longitudinally opposite ends to the corresponding pair of auxiliary rods 54 which extend inward from the respective rods 53.

As shown in FIG. 11, the operation of step S4 is carried out by using a flexible sheet 52 which has a width slightly larger than a length of each ink channel unit 10, and an adhesive applier plate 51 which has a sharp edge and a width substantially equal to the width of the flexible sheet 52. The flexible sheet 52 has the adhesive deposited on one of its opposite side surfaces. In the operation, the plate 51 is moved relative to the ink channel units 10 while the flexible sheet 52 interposed between the plate 51 and the ink channel units 10 is forced by the edge of the plate 51 onto the recessed surface (or opening defining surface) of each ink channel unit 10, such that the flexible sheet 52 is brought into pressing contact, at the above-described one of the opposite side surfaces, with the recessed surface of each unit 10, whereby the adhesive deposited on the surface of the sheet 52 is transferred onto the recessed surface of each unit 10. Since the plate 51 is moved relative to each channel unit 10 in a direction, as indicated by arrow in FIG. 11, corresponding to the width direction of each unit 10, the applied adhesive is caused to expand in a direction away from the long side 15*a* of each unit 10 toward the other long side 15*b* of each unit 10.

The ink channel unit 10, onto which the adhesive has been applied at step S4, is partially shown in a plan view and a cross sectional view at (b) of FIG. 12. As is apparent from the views at (b) of FIG. 12, each of the capture holes 34 is filled, at its part which is relatively close to the long side 15*a* and which is about half of its entirety, with the adhesive 33 applied onto the recessed surface of the ink channel unit 10. This can be explained by that the adhesive is applied onto the recessed surface in the direction away from the long side 15*a* toward the other long side 15*b* so that a majority of excess of the adhesive 33 moving toward each pressure chamber 36 is captured by the corresponding capture hole 34 which is located on an immediately upstream side of the pressure chamber 36 as viewed in the direction of application of the adhesive. Thus, the adhesive 33 little flows into the pressure chambers 36. It is noted that the applied adhesive 33 is not yet cured or hardened at a stage shown in the views at (b) of FIG. 12.

Step S4 is followed by step S5 implemented to mount the actuator unit 20 onto the ink channel unit 10 onto which the adhesive has been applied. In this instance, the actuator unit 20 is positioned relative to the ink channel unit 10 such that the individual electrodes 24 are opposed to or aligned with the respective pressure chambers 36. This positioning operation is made based on reference marks which have been formed in the units 10, 20 in steps 1-3.

In the subsequent Step S6, the laminar structure constituted by the units 10, 20 is pressed while being heated at a temperature not lower than a setting temperature of the thermosetting adhesive, by using a heating/pressing apparatus. With the thermosetting adhesive being cured, the units 10, 20 are fixedly connected to each other.

The laminar structure, constituted by the units 10, 20 which have been fixed to each other in step S5, is partially shown in a plan view and a cross sectional view at (c) of FIG. 12. As is apparent from the views at (c) of FIG. 12, in the inkjet head 1 constructed according to the embodiment of the invention with is formed with the capture holes 34, 47*a*, 47*b*, 47*c* and capture recess 48*a* for capturing therein the adhesive 33, there is no risk that each individual ink channel of the ink channel unit 10 would be closed by the adhesive and no risk that the volume of each pressure chamber 36 would considerably deviate from its designed value.

Step S6 is followed by step S7 in which the laminar structure taken out of the heating/pressing apparatus is self-cooled, so that a main body of the inkjet head 1 constituted by the ink channel unit 10 and actuator unit 20 is obtained. Then, the inkjet head 1 is completed after implementation of the subsequent step or steps in which the flexible flat cable 40 is attached to the actuator unit 20.

As is clear from the above description, in the process of applying the adhesive onto the surface of each plate of the ink defining unit 10, most of the excess adhesive moving toward the recesses and through-holes constituting the individual ink channels such as the pressure chambers 36 and nozzles 35 is captured by the capture holes 34, before reaching the recesses and through-holes, thereby remarkably reducing an amount of the adhesive 33 undesirably flowing into the recesses and through-holes constituting the ink channels. It is therefore possible to restrain reduction in a yield ratio of the inkjet head 1 and variation in an ejection characteristic of the inkjet head 1, due to clogging of the individual ink channels, even if an amount of the applied adhesive is increased to be larger than in a conventional inkjet head, thereby eliminating necessity of strictly controlling the applied adhesive amount.

Further, in the inkjet head 1 constructed according to the embodiment of the invention, each of the pressure chambers 36 formed in the base plate 15 has an oblong shape, and each pressure chamber 36 and the corresponding capture hole 34 are distant from each other in the longitudinal direction of the oblong-shaped pressure chamber 36. This arrangement makes it possible, where the adhesive is sequentially applied onto the ink channel unit 10 in the direction away from the long side 15*a* toward the other long side 15*b* as shown in FIG. 11, to reduce an amount of the excess adhesive passing the capture holes 34 and moving toward the pressure chambers 36, even if the width of each capture hole 34 is made small for restraining reduction in rigidity of the ink channel unit 10.

Further, in the inkjet head 1 of the present embodiment, the ink channel unit 10 is a laminar structure including a plurality of plates superposed on each other, and the capture holes 34 are provided by through-holes formed through the base plate 15 which provides the recessed surface of the ink channel unit 10. This arrangement permits each capture hole 34 to be given a volume large enough to reliably capture the excess of the adhesive 33 which is applied onto the ink channel unit 10 for fixing the unit 10 to the actuator unit 20.

Further, in the inkjet head 1 of the present embodiment, the pressure chambers 36 and the capture holes 34 are positioned relative to each other such that each of the pressure chambers 36 is accompanied by a corresponding one of the capture holes 34. In other words, each capture hole 34 is not an elongated hole common to the multiplicity of pressure chambers 36, but is provided for a corresponding one of the pressure chambers 36. Each pressure chamber 36 and the corresponding capture hole 34 have respective width values as measured in the longitudinal direction of the ink channel unit 10, such that the width value of the capture hole 34 is substantially equal to or larger than that of the pressure chamber 36. It is therefore possible to further reduce the amount of the adhesive flowing into the pressure chambers 36, while restraining reduction in the rigidity of the base plate 15 and the ink channel unit 10 as a whole. Similarly, each of the through-holes 37*b*, 37*c*, 37*d* is accompanied by a corresponding one of the capture holes 47*a*, 47*b*, 47*c*, while each of the nozzles 35 is accompanied by a corresponding one of the capture recesses 48*a*. Each of the through-holes 37*b*, 37*c*, 37*d* and the corresponding one of the capture holes 47*a*, 47*b*, 47*c* have respective width values as measured in the longitudinal direction of the ink channel unit 10, such that the width value of the through-hole 37*b*, 37*c*, 37*d* is substantially equal to or larger than that of the capture hole 47*a*, 47*b*, 47*c*. Each of the nozzles 35 and the corresponding one of capture recesses 48*a* have respective width values as measured in the longitudinal direction of the ink channel unit 10, such that the width value of the nozzles 35 is substantially equal to or larger than that of the capture recess 48*a*. It is therefore possible to further reduce the amount of the adhesive flowing into the through-holes 37*b*, 37*c*, 37*d* and nozzles 35, while restraining reduction in the rigidity of the plates 11-14 and the ink channel unit 10 as a whole. It is noted that the adhesive is not applied onto the plate 14 having the through-holes 37*a*, as described above, so that there is no risk that the adhesive would flow into the through-holes 37*a*, in spite of absence of capture holes in the plate 14.

Further, in the inkjet head 1 of the present embodiment, each capture holes 34 has, in one of opposite portions that is more distant from the corresponding pressure chamber 36, the curvature substantially equal to the curvature of one of opposite portions of the corresponding pressure chamber 36 that is closer to the each capture hole 34. This arrangement facilitates the excess adhesive to flow into the capture holes 34 in step S3 of the manufacturing process, thereby making it possible to further reduce the amount of the adhesive flowing into the pressure chambers 36. Similarly, each of the capture holes 47*a*, 47*b*, 47*c* and recesses 48*a* has, in one of opposite portions that is more distant from a corresponding one of the through-holes 37*b*, 37*c*, 37*a* and nozzles 35, the curvature substantially equal to the curvature of one of opposite portions of the corresponding one of the through-holes 37*b*, 37*c*, 37*a* and nozzles 35 that is closer to each of the capture holes 47*a*, 47*b*, 47*c* and recesses 48*a*. This arrangement facilitates the excess adhesive to flow into the capture holes 47*a*, 47*b*, 47*c* and recesses 48*a* in step S1 of the manufacturing process, thereby making it possible to further reduce the amount of the adhesive flowing into the through-holes 37*b*, 37*c*, 37*a* and nozzles 35. Further, the excess of the expanded adhesive 33 is caused to flow into the portions of the capture holes 34, 47*a*, 47*b*, 47*c* and recesses 48*a* having shapes substantially identical with the shapes of the upstream end portions of the pressure chambers 36, through-holes 37*b*, 37*c*, 37*a* and nozzles 35. That is, the excess of the adhesive 33 is reduced, by causing the adhesive 33 to flow into the capture holes 34, 47*a*, 47*b*, 47*c* and recesses 48*a* by substantially the same degree as in an arrangement in which the adhesive 33 is caused to flow into the pressure chambers 36, through-holes 37*b*, 37*c*, 37*a* and nozzles 35 in absence of the capture holes 34, 47*a*, 47*b*, 47*c* and recesses 48*a*. It is therefore not necessary to strictly control the amount of the excess adhesive caused after the adhesive applier has passed the capture holes 34, 47*a*, 47*b*, 47*c* and recesses 48*a*. For example, since the amount of the excess adhesive is dependent on the distance between each of the capture holes 34, 47*a*, 47*b*, 47*c* and recesses 48*a*, and a corresponding one of the pressure chambers 36, through-holes 37*b*, 37*c*, 37*a* and nozzles 35, it is possible to increase a degree of freedom with respect to an amount of thickness of the applied adhesive, although a permissible range of amount of the adhesive captured by the capture holes 34, 47*a*, 47*b*, 47*c* and recesses 48*a* has to be taken account.

Further, all the pressure chambers 36 are the same with respect to a direction of the position of the corresponding capture hole 34 relative to the position of each pressure chamber 36 (accompanied by the corresponding capture hole 34), so that the excess adhesive moving toward each pressure chamber 36 is captured by the corresponding capture hole 34, so as to be reduced. It is therefore possible to minimize the amount of the adhesive flowing into each pressure chamber 36 and eliminate necessity of controlling the amount of the excess adhesive caused before the adhesive applier reaches the capture holes 34. Further, the rows 32*a*, 32*c* of the capture holes 34 and the rows 32*b*, 32*d* of the pressure chambers 36 are alternately arranged as viewed in the direction away from the long side 15*a* of the base plate 15 toward the other long side 15*b* of the plate 15. This arrangement makes it possible to restrain the amount of the excess adhesive passing the capture holes 34 (belonging to the rows 32*a*, 32*c*) and moving toward the pressure chambers 36 (belonging to the rows 32*b*, 32*d*), thereby further reducing the amount of the adhesive flowing into the pressure chambers 36 (belonging to the rows 32*b*, 32*d*). The same thing can be said of the relation between each of the through-holes 37*b*, 37*c*, 37*d* and nozzles 36 and a corresponding one of the capture holes 47*a*, 47*b*, 47*c* and recesses 48*a*.

Further, since the pressure chambers 36 are arranged in the rows 32*b*, 32*d* extending in the longitudinal direction of the ink channel unit 10, where the adhesive is intended to be applied onto the ink channel unit 10 in a manner that causes the applied adhesive to flow into the capture holes 34, the direction of the application of the adhesive can correspond to the width direction of the unit 10 rather than the longitudinal direction of the unit 10, thereby advantageously reducing a length of time required to apply the adhesive onto the unit 10.

Further, in the inkjet head 1 of the present embodiment, the actuator unit 20 is bonded to the base plate 15, such that the intersection 20*a* of the ink channel unit 10 and a side wall defining a long side of the actuator unit 20 is located between the row 32*a* of the capture holes 34 (which is the closest to the long side 15*a*) and the row 32*b* of the pressure chambers 36 (which is adjacent to the row 32*a*), and extends in the longitudinal direction of the ink channel unit 10. This arrangement enables the actuator unit 20 to be reliably fixed to the ink channel unit 10. Further, since the capture holes 34 are located between the row 32*b* of the pressure chambers 36 and the long side 15*a*, the excess of the adhesive 33 expanded in the direction away from the long side 15*a* is captured by the capture holes 34, so that the adhesive applied onto a region between the row 32*b* of the pressure chambers 36 and the row 32*a* of the capture holes 34 is given a predetermined thickness. Therefore, where the actuator unit 20 is positioned relative to the base plate 15 such that the intersection 20*a* is located between the rows 32*a* and 32*b*, the actuator unit 20 can be fixed to the base plate 15 with an amount of the adhesive which is well controlled. That is, even if the unit 20 is fixed to the base plate 15 with a somewhat excessive amount of the adhesive, the excessive amount is not beyond a permissible range assuring the ejection characteristic of the inkjet head 1, while the unit 20 can be reliably fixed to the base plate 15.

Further, in the inkjet head 1 of the present embodiment, since the plurality of pairs of pressure chambers 36 and capture holes 34 are the same with respect to a spacing distance between each pressure chamber 36 and the corresponding capture hole 34 as measured in the width direction of the ink channel unit 10, the amounts of the adhesive flowing into the respective pressure chambers 36 can be substantially equalized to each other, where the adhesive is sequentially applied on the ink channel unit 10 in the width direction of the unit 10, i.e., in the direction away from the capture holes 34 toward the pressure chambers 36. Thus, variation among the pressure chambers 36 with respect to their volumes can be made small. The same thing can be said of the relation between each of the through-holes 37*b*, 37*c*, 37*d* and nozzles 35 and a corresponding one of the capture holes 47*a*, 47*b*, 47*c* and recesses 48*a*.

Further, in the inkjet head 1 of the present embodiment, the row 32*a* of the capture holes 34 is located between the row 32*b* of the pressure chambers 36 and one 15*a* of the opposite long sides of the ink channel unit 10 closer to the row 32*b* of the pressure chambers 36, so that the distance between the long side 15*a* and the row 32*a* of the capture holes 34 is made relatively small. Therefore, the amount of excess adhesive reaching the capture holes 34 is made small where the adhesive is sequentially applied onto the ink channel unit 10 in the direction away from the long side 15*a* toward the other long side 15*b*, as shown in FIG. 11. The amount of the excess adhesive reaching the capture holes 34 can be reduced to be smaller than an upper limit of capacity of the capture holes 34 of capturing the adhesive, thereby avoiding of risk of overflowing of the excess adhesive from the capture holes 34 and resulting in a further reliable reduction in the amount of the adhesive flowing into the pressure chambers 36. On the contrary, the distance between the long side 15*a* and the row 32*a* of the capture holes 34 may be increased, for example, in view that the ink channel unit 10 requires to have, in its peripheral portion, a bonding region sufficiently large for enabling the unit 10 to be bonded to the frame 141 in the present embodiment in which the inkjet head 1 is fixed to the holder 172 through the frame 141. Where the bonding region is required in the peripheral portion of the unit 10, the distance between the long side 15*a* and the row 32*a* of the capture holes 34 can be increased within a range of capacity of the capture holes 34 of capturing the adhesive, as long as the distance between the row 32*a* of the capture holes 34 and the row 32*b* of the pressure chambers 36 is determined such that the amount of the excess adhesive is not larger than a permissible upper limit.

While a preferred embodiment of this invention has been described above, it is to be understood that the invention is not limited to the details of the illustrated embodiment, but may be embodied with various changes and modifications, which may occur to those skilled in the art, without departing from the spirit and scope of the present invention. For example, each of the pressure chambers 36 does not necessarily have to have an elongated shape or oblong rectangular shape, but may have any other shape such as rectangular shape (with four sides of equal length), triangular shape and elliptic shape. Similarly, the shape of each of the capture holes 34 may be changed as needed. Further, each capture hole 34 does not have to be located in the same position as the corresponding pressure chamber 36 as viewed in the direction perpendicular to the elongated direction of the pressure chamber 36, as long as each capture hole 34 is located on an upstream side of the corresponding pressure chamber 36 as viewed in the direction of application or expansion of the adhesive.

In the above-described embodiment, the pressure chambers 36 and the capture holes 34 are positioned relative to each other such that each of the pressure chambers 36 is accompanied by a corresponding one of the capture holes 34, namely, the pressure chambers 36 and the capture holes 34 cooperate to constitute a plurality of pairs of recesses or openings, each of which is constituted by the single pressure chamber 36 and the single capture hole 34. However, this arrangement may be changed such that each pressure chamber 36 is accompanied by two or more capture holes 34. Further, the width of each capture hole 34 may be smaller than the width of the corresponding pressure chamber 36. Still further, each capture hole 34 may have, in its portions which is more distant from the corresponding pressure chamber 36, a shape different from that of the portion of the corresponding pressure chamber 36 which is closer to the capture hole 34.

While the plurality of pairs of recesses or openings are same with respect to the spacing distance between each pressure chamber 36 and the corresponding capture hole 34 in the above-described embodiment, they do not have to be necessarily the same. However, also in an arrangement in which there are differences among the plurality of pairs of recesses or openings with respect to the spacing distance between each pressure chamber 36 and the corresponding capture hole 34, it is preferable that the above-described spacing distance in any one of the pairs is held within a range avoiding the ink ejection characteristic of each individual ink channel from being affected by the excess adhesive which could be caused after the adhesive applier has passed the capture hole 34, in the interest of substantially equalizing the individual ink channels with respect to the ink ejection characteristic.

In addition, the alternate arrangement of the rows 32*a*, 32*c* of the capture holes 34 and the rows 32*b*, 32*d* of the pressure chambers 36 is not essential. For example, the two rows 32*a*, 32*c* of the capture holes 34 may be interposed between the two rows 32*b*, 32*d* of the pressure chambers 36. Thus, the arrangement of the rows 32*a*, 32*b*, 32*c*, 32*d* may be changed as needed for increasing a degree of freedom with respect to the direction of the application of adhesive.

Where the inkjet head 1 is designed for attending a need for printing higher resolution and density of image, the number of required individual ink channels formed in the region opposed to the actuator unit 20 is increased to be larger than in the above-described embodiment. In the ink channel unit 10 formed with the ink channels with a higher density, there is neither a space available for the formation of the capture holes 34 in the region opposed to the actuator unit 20, nor a portion having a large distance casing the adhesive to be considerably excessed. In this case, rather, it is necessary to avoid the excess adhesive caused in the region between the long side 15*a* of the ink channel unit 10 and the above-described intersection 20*a*, from flowing into the region of the ink channel unit 10 in which the recesses or holes are formed to provide the ink channels. In view of this, it is preferable at least that the row of the capture holes 34 is located adjacent to the long side 15*a* which is one of opposite long sides 15*a*, 15*b* that is located on an upstream side of the other long side 15*b* as viewed in the direction of application of the adhesive. However, two rows of the capture holes 34 may be provided on opposite sides of the region of the ink channel unit 10 which is opposed to the actuator unit 20, so that the degree of freedom with respect to the direction of the application of the adhesive can be increased. Further, the provision of the two rows of the capture holes 34 enables the inkjet to be further reliably fixed to the frame and holder. Further, the ink channel unit 10 does not necessarily have to be a laminar structure consisting of a plurality of superposed plates.

While each of the capture holes 34 as the second recesses is provided by a through-hole formed through the base plate 15 in the above-described embodiment, each capture hole 34 may be provided by a recess formed in the base plate 15. Further, each of the second recesses may have a larger depth so as to have a bottom wall which is defined by one of the plates underlying the base plate 15 rather than by the base plate 15.

The rows 32*a* of the capture holes 34 may be positioned to be closer to the intersection 20*a* (of the side wall of the unit 20 and the recessed surface of the ink channel unit 10) than in the above-described embodiment in which the rows 32*a* is positioned substantially in a center between the intersection 20*a* and the long side 15. This modified arrangement leads to a reduction in the distance between each capture hole 34 and the corresponding pressure chamber 34, thereby making it possible to reduce the amount of the excess adhesive caused after the adhesive applier has passed the capture holes 34 in the bonding process.

In the above-described embodiment, each of adjacent pair of plates such as the nozzle plate 11 and damper plate 12; the damper plate 12 and manifold plate 13Y; the manifold plate 13Y and manifold plate 13X; the manifold plate 13X and spacer plate 14; and the base plate 15 and piezoelectric sheet 21 corresponds to first and second plates, respectively, wherein the first plate having an opening defining surface which defines a plurality of first openings and a plurality of second openings, while the second plate is fixed to the opening defining surface of the first plate by an adhesive. The opening of either the pressure chambers 36, through-holes 37*b*, 37*c*, 37*d* and nozzles 35 correspond to the first openings, while the opening of either the capture holes 34, 47*a*, 47*b*, 47*c* and recesses 48*a* correspond to the second openings. Each of the second openings may be formed in any one of surfaces of the plates which is formed with an opening held in communication with one of the nozzles 35. For example, an opening may be formed adjacent to the opening of the ink supply hole 13, so that the formed opening and opening of the ink supply hole 13 correspond to the second opening and the first opening, respectively. Further, an opening may be formed adjacent to the opening of the common chamber 7, so as to serve as the second opening. Each of the first and second openings may be either an opening of a though-hole formed through one of the plates or an opening of a blind hole or recess formed in one of the plates.

Further, the process employable to manufacture the inkjet head of the invention is not limited to the above-described manufacturing process in which the adhesive is applied onto the base plate 15 in the direction away from the long side 15*a* toward the other long side 15*b* as shown in FIG. 11. For example, the adhesive may be applied in a direction somewhat inclined with respect to the direction away from the long side 15*a* toward the other long side 15*b*, namely, with respect to a direction in which a straight line connecting each pressure chamber 36 and the corresponding capture hole 34 extends.

What is claimed is:

1. An inkjet head comprising a laminar structure including a plurality of plates superposed on each other, said laminar structure having a plurality of nozzles which are defined in an endmost one of said plurality of plates, such that ink can be ejected through said plurality of nozzles, for performing a recording operation, wherein said plurality of plates includes a first plate having (i) a plurality of first openings which includes all openings which are defined in an opening defining surface of said first plate and which are held in communication with said plurality of nozzles, and (ii) a plurality of second openings which includes all openings which are defined in said opening surface of said first plate and which are isolated from all of said plurality of nozzles, such that a number of said second openings is not smaller than a number of said first openings, wherein said second openings are positioned relative to said first openings such that each of said first openings is accompanied by at least one of said second openings, wherein said plurality of plates includes a second plate fixed to said opening defining surface of said first plate by an adhesive, and wherein at least a portion of the adhesive is located inside at least one of said plurality of second openings.

2. The inkjet head according to claim 1, wherein said each of said first openings and a corresponding second opening as one of said at least one of said second openings cooperate with each other to constitute a pair of openings, so that said first and second openings constitute a plurality of pairs of openings, and wherein said plurality of pairs of openings are the same with respect to a direction and a distance in and by which said each of said first openings and said corresponding second opening are distant from each other.

3. The inkjet head according to claim 2, wherein said each of said first openings and said corresponding second opening have a first width and a second width, respectively, such that said second width is not smaller than said first width.

4. The inkjet head according to claim 3, wherein said corresponding second opening has, in one of opposite portions that is more distant from said each first opening than the other portion of said corresponding second opening, a shape substantially identical with a shape of one of opposite portions of said each first opening that is closer to said corresponding second opening than the other portion of said each first opening.

5. The inkjet head according to claim 2, wherein said plurality of pairs of openings are the same with respect to a direction in which said each of said first openings and said corresponding second opening are distant from each other.

6. The inkjet head according to claim 1, wherein said laminar structure includes (a) an ink channel unit and (b) an actuator unit which are superposed on each other and which cooperate with each other to provide said plurality of plates, wherein said ink channel unit includes said first plate, and has (a-1) said plurality of nozzles, (a-2) said plurality of first openings which are held in communication with said plurality of nozzles and which are formed in said opening defining surface of said first plate, and (a-3) said plurality of second openings which are isolated from said plurality of nozzles and which are formed in said opening defining surface, wherein said actuator unit includes said second plate, and has (b-1) a piezoelectric sheet straddling said plurality of first openings, (b-2) a plurality of individual electrodes located in positions opposed to the respective first openings, and (b-3) a common electrode cooperating with each of said individual electrodes to define a portion of said piezoelectric sheet which is located between said common electrode and said each of said individual electrodes, and wherein said actuator unit is fixed to said opening defining surface of said ink channel unit by the adhesive, such that said first openings are closed by said actuator unit so as to provide respective pressure chambers.

7. The inkjet head according to claim 6, wherein each of said first openings is elongated in an elongated direction, and wherein said each of said first openings and a corresponding second opening as one of said at least one of said second openings are spaced apart from each other in said elongated direction, and are located in substantially the same position in a direction perpendicular to said elongated direction.

8. The inkjet head according to claim 7, wherein said each of said first openings and said corresponding second opening have a first width and a second width, respectively, as measured in said direction perpendicular to said elongated direction, such that said second width is not smaller than said first width.

9. The inkjet head according to claim 8, wherein said each of said first openings and said corresponding second opening cooperate with each other to constitute a pair of openings, and wherein said corresponding second opening has, in one of opposite portions that is more distant from said each first opening than the other portion of said corresponding second opening, a shape substantially identical with a shape of one of opposite portions of said each first opening that is closer to said corresponding second opening than the other portion of said each first opening.

10. The inkjet head according to claim 8, wherein said each of said first openings and said corresponding second opening cooperate with each other to constitute a pair of openings, so that said first and second openings constitute a plurality of pairs of openings, and wherein said plurality of pairs of openings are the same with respect to a direction of a position of said corresponding second opening relative to a position of said each of said first openings.

11. The inkjet head according to claim 8, wherein each of said ink channel unit and said actuator unit has an oblong shape in a plan view of said inkjet head, wherein said first openings are arranged in at least one row extending in a longitudinal direction of said ink channel unit, such that said first openings are elongated in a width direction of said ink channel unit, wherein said second openings are located between said at least one row of said first openings and a long side of said ink channel unit, and wherein said first openings are located on one of opposite sides of an intersection of a long side wall of said actuator unit and said opening defining surface of said ink channel unit, while said second openings are located on the other of said opposite sides of said intersection.

12. The inkjet head according to claim 11, wherein said each of said first openings and said corresponding second opening cooperate with each other to constitute a pair of openings, so that said first and second openings constitute a plurality of pairs of openings, and wherein said plurality of pairs of openings are the same with respect to a spacing distance between said each of said first openings and said corresponding second opening as measured in said width direction of said ink channel unit in which said first openings are elongated.

13. The inkjet head according to claim 11, wherein said long side of said ink channel unit is one of opposite long sides of said ink channel unit that is closer to said at least one row of said first openings, than the other of said opposite long sides.

14. The inkjet head according to claim 6, wherein said first openings are located on one of opposite sides of at least a part of an intersection of a side wall of said actuator unit and said opening defining surface of said ink channel unit, while said second openings are located on the other of said opposite sides of at least said part of said intersection.

15. The inkjet head according to claim 1, wherein said second openings are provided by through-holes formed through one of said plurality of plates which provides said opening defining surface of said ink channel unit.

16. An inkjet head comprising a laminar structure including a plurality of plates superposed on each other, said laminar structure having a plurality of nozzles through which ink can be ejected for performing a recording operation, wherein said plurality of plates includes a first plate having an opening defining surface which defines a plurality of first openings and a plurality of second openings, wherein said second openings are positioned relative to said first openings such that each of said first openings is accompanied by at least one of said second openings, and such that a number of said second openings is not smaller than a number of said first openings, wherein said first openings are held in communication with said plurality of nozzles which are defined in an endmost one of said plurality of plates, while said second openings are isolated from all of said plurality of nozzles, wherein said plurality of plates includes a second plate fixed to said opening defining surface of said first plate by an adhesive, wherein at least a portion of the adhesive is located inside at least one of said plurality of second openings, wherein said laminar structure includes (a) an ink channel unit and (b) an actuator unit which are superposed on each other and which cooperate with each other to provide said plurality of plates, wherein said ink channel unit includes said first plate, and has (a-1) said plurality of nozzles, (a-2) said plurality of first openings which are held in communication with said plurality of nozzles and which are formed in said opening defining surface of said first plate, and (a-3) said plurality of second openings which are isolated from said plurality of nozzles and which are formed in said opening defining surface, wherein said actuator unit includes said second plate, and has (b-1) a piezoelectric sheet straddling said plurality of first openings, (b-2) a plurality of individual electrodes located in positions opposed to the respective first openings, and (b-3) a common electrode cooperating with each of said individual electrodes to define a portion of said piezoelectric sheet which is located between said common electrode and said each of said individual electrodes, wherein said actuator unit is fixed to said opening defining surface of said ink channel unit by the adhesive, such that said first openings are closed by said actuator unit so as to provide respective pressure chambers, wherein each of said first openings is elongated in an elongated direction, wherein said each of said first openings and a corresponding second opening as one of said at least one of said second openings are spaced apart from each other in said elongated direction, and are located in substantially the same position in a direction perpendicular to said elongated direction, wherein said each of said first openings and said corresponding second opening have a first width and a second width, respectively, as measured in said direction perpendicular to said elongated direction, such that said second width is not smaller than said first width, wherein each of said ink channel unit and said actuator unit has an oblong shape in a plan view of said inkjet head, wherein said first openings are arranged in at least one row extending in a longitudinal direction of said ink channel unit, such that said first openings are elongated in a width direction of said ink channel unit, wherein said second openings are located between said at least one row of said first openings and a long side of said ink channel unit, wherein said first openings are located on one of opposite sides of an intersection of a long side wall of said actuator unit and said opening defining surface of said ink channel unit, while said second openings are located on the other of said opposite sides of said intersection, wherein said first openings are arranged in a plurality of first rows as said at least one row extending in said longitudinal direction of said ink channel unit, while said second openings are arranged in a plurality of second rows extending in said longitudinal direction of said ink channel unit, and wherein said first and second rows are alternately arranged in said width direction of said ink channel unit.

17. An inkjet head comprising a laminar structure including a plurality of plates superposed on each other, said laminar structure having a plurality of nozzles through which ink can be ejected for performing a recording operation, wherein said plurality of plates includes a first plate having an opening defining surface which defines a plurality of first openings and a plurality of second openings, wherein said second openings are positioned relative to said first openings such that each of said first openings is accompanied by at least one of said second openings, and such that a number of said second openings is not smaller than a number of said first openings, wherein said first openings are held in communication with said plurality of nozzles which are defined in an endmost one of said plurality of plates, while said second openings are isolated from all of said plurality of nozzles, wherein said plurality of plates includes a second plate fixed to said opening defining surface of said first plate by an adhesive, wherein at least a portion of the adhesive is located inside at least one of said plurality of second openings, wherein said laminar structure includes (a) an ink channel unit and (b) an actuator unit which are superposed on each other and which cooperate with each other to provide said plurality of plates, wherein said ink channel unit includes said first plate, and has (a-1) said plurality of nozzles, (a-2) said plurality of first openings which are held in communication with said plurality of nozzles and which are formed in said opening defining surface of said first plate, and (a-3) said plurality of second openings which are isolated from said plurality of nozzles and which are formed in said opening defining surface, wherein said actuator unit includes said second plate, and has (b-1) a piezoelectric sheet straddling said plurality of first openings, (b-2) a plurality of individual electrodes located in positions opposed to the respective first openings, and (b-3) a common electrode cooperating with each of said individual electrodes to define a portion of said piezoelectric sheet which is located between said common electrode and said each of said individual electrodes, wherein said actuator unit is fixed to said opening defining surface of said ink channel unit by the adhesive, such that said first openings are closed by said actuator unit so as to provide respective pressure chambers, wherein said first openings include ones arranged in two rows which are substantially parallel to each other, and wherein said second openings include ones located between said two rows of said first openings.

18. The inkjet head according to claim 17, wherein said first openings arranged in said two rows cooperate to form a zigzag pattern, and wherein each of said second openings located between said two rows is located in substantially the same position as a corresponding one of said first openings of one of said two rows in a direction in which said one of said two rows extends.

* * * * *